US009903675B2

(12) United States Patent
Cassels

(10) Patent No.: US 9,903,675 B2
(45) Date of Patent: Feb. 27, 2018

(54) MULTI-BLOCK GAS REGULATOR

(71) Applicant: Charles B. Cassels, New Smyma Beach, FL (US)

(72) Inventor: Charles B. Cassels, New Smyma Beach, FL (US)

( * ) Notice: Subject to any disclaimer, the term of this patent is extended or adjusted under 35 U.S.C. 154(b) by 0 days.

(21) Appl. No.: 14/970,782

(22) Filed: Dec. 16, 2015

(65) Prior Publication Data

US 2016/0178299 A1 Jun. 23, 2016

Related U.S. Application Data

(60) Provisional application No. 62/095,289, filed on Dec. 22, 2014.

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/24; F41A 5/26; F41A 5/28
USPC ..... 89/191.01, 191.02, 193
See application file for complete search history.

(56) References Cited

U.S. PATENT DOCUMENTS 4,244,273 A * 1/1981 Langendorfer, Jr. ..... F41A 5/28 89/193
7,418,898 B1 * 9/2008 Desomma ..... F41A 5/30 89/191.02
7,461,581 B2 12/2008 Leitner-Wise
7,469,624 B1 * 12/2008 Adams ..... F41A 5/26 89/191.01
7,610,844 B2 * 11/2009 Kuczynko ..... F41A 5/28 89/193
7,739,939 B2 * 6/2010 Adams ..... F41A 5/26 89/191.01
7,856,917 B2 * 12/2010 Noveske ..... F41A 5/28 89/193
7,934,447 B2 5/2011 Kuczynko et al.
7,971,518 B2 7/2011 Adams
8,161,864 B1 * 4/2012 Vuksanovich ..... F41A 5/26 89/191.01

(Continued)

*Primary Examiner* — Derrick R Morgan
(74) *Attorney, Agent, or Firm* — Carter, DeLuca, Farrell & Schmidt, LLP

(57) ABSTRACT

A multi use retro fit capable adjustable gas block designed to interface with an autoloading gas operated firearm is provided to replace existing gas blocks. The adjustable gas block optimizes gas flow into the host firearms operating system. The adjustable gas block has a spring loaded adjustment knob that releases when pulled forward allowing it to rotate. By rotating the adjustment knob the gas flow is increased or decreased based on one of four provided gas settings. Setting one is optimal for using a silencer, setting two is optimal for normal operations, setting three is optimal for adverse conditions, and setting four either turns the gas flow off optimizing sound reduction and providing for manual operation, or provides an extra high gas setting for the host firearm. The system works by precisely metering gas entering the operating system and not by exhausting excess gas into the atmosphere. The adjustable gas regulator may be configured with a piston operating system or a direct gas impingement operating system, e.g. gas tube, as is the case with the standard AR-15/AR-10 family of firearms.

17 Claims, 12 Drawing Sheets

(56) References Cited

U.S. PATENT DOCUMENTS 8,210,089 B2 7/2012 Brown
8,607,688 B2 * 12/2013 Cassels ..... F41A 5/28 89/191.01
8,813,632 B2 * 8/2014 Adams ..... F41A 5/28 89/191.01
9,134,082 B2 * 9/2015 Brown ..... F41A 5/18
9,671,184 B1 * 6/2017 Russo ..... F41A 5/18
2003/0121444 A1 7/2003 Mutascio et al.
2009/0229454 A1 * 9/2009 Fluhr ..... F41A 5/28 89/193
2010/0095834 A1 4/2010 Kuczynko et al.
2010/0199836 A1 8/2010 Herring
2010/0218671 A1 * 9/2010 Mayberry ..... F41A 5/28 89/192
2010/0275769 A1 * 11/2010 Brittingham ..... F41A 21/34 89/193
2010/0275770 A1 * 11/2010 Noveske ..... F41A 5/28 89/193
2011/0023699 A1 * 2/2011 Barrett ..... F41A 5/28 89/193
2011/0271827 A1 * 11/2011 Larson ..... F41A 5/28 89/193
2012/0131834 A1 * 5/2012 Barrett ..... F41A 3/26 42/75.02
2012/0132068 A1 * 5/2012 Kucynko ..... F41C 23/16 89/191.01
2012/0152104 A1 * 6/2012 Audibert ..... F41A 5/18 89/191.01
2012/0152106 A1 * 6/2012 Langevin ..... F41A 5/24 89/193
2012/0167757 A1 * 7/2012 Gomez ..... F41A 5/28 89/193
2013/0055883 A1 * 3/2013 Cassels ..... F41A 5/28 89/193
2013/0284008 A1 * 10/2013 Pizano ..... F41A 5/26 89/193
2014/0060312 A1 * 3/2014 Ruck ..... F41A 5/28 89/193
2014/0076143 A1 * 3/2014 Hall ..... F41A 19/03 89/129.01
2014/0076150 A1 * 3/2014 Brinkmeyer ..... F41A 5/28 89/193
2014/0083286 A1 * 3/2014 Gomez ..... F41A 5/18 89/193
2014/0182450 A1 * 7/2014 Boutin, Jr. ..... F41A 5/18 89/193
2014/0190344 A1 * 7/2014 Kenney ..... F41A 5/28 89/193
2014/0260947 A1 * 9/2014 Gomez ..... F41A 5/28 89/193
2015/0253091 A1 * 9/2015 Gardner ..... F41A 5/28 89/193
2015/0292825 A1 * 10/2015 Cassels ..... F41A 5/28 89/193
2016/0033219 A1 * 2/2016 Meier ..... F41A 3/66 89/191.01
2016/0178299 A1 * 6/2016 Cassels ..... F41A 5/28 89/193
2016/0209138 A1 * 7/2016 DeSomma ..... F41A 5/28
2016/0265860 A1 * 9/2016 Schilling ..... F41A 5/28

* cited by examiner

MULTI-BLOCK GAS REGULATOR

BACKGROUND

1. Technical Field

The present disclosure relates generally to self-loading firearms and, more particularly to, a multi-block gas regulator for use with self-loading firearms that can be easily disassembled.

2. Description of the Related Art

Adjustable gas regulators have been utilized on self loading firearms since the 1940's. Some early examples are the Soviet SVD and Belgium FAL, while the Adams Arms, Sig Sauer 516 and the Ruger SR-556 are some recent designs.

Early on gas regulators were developed to enable discharge gas pressure to be adjusted on a host firearm. The use of gas regulators was necessitated by ammunition that produced inconsistent pressures that led to excessive wear and or malfunctions of a firearm's operating system.

More recently with the increased use of silencers, the role of gas regulators took on a new priority in the form of managing back pressure. Back pressure is created by a silencer forcing more discharge gas into the rifles operating system. The increase in the volume of discharge gas, passing \through the operating system of a firearm resulted in increased fouling, felt recoil, accelerated wear of the firearm's components and a plethora of operation related malfunctions.

With the early designs like the Belgian FAL, the discharge gas was regulated by allowing excess gas to be exhausted into the atmosphere. However, such regulation was not practical with firearms utilizing a silencer because when discharge gas entered the oxygen rich atmosphere, the gases flashed and produced a report that nullified the silencing effect of the silencer. Furthermore, the regulator did not provide preset gas settings. Other disadvantages include requiring a tool to adjust the gas settings and the inability to rapidly adjust the gas flow while the weapon is fielded.

Modern designs like Adams Arms have made some improvements over earlier designs in the following ways: restricting the amount of discharge gas allowed to escape into the atmosphere. 2) By equipping their regulators with preset gas adjustments; and 3) providing a means to change gas settings in the field without requiring the use of tools.

The problems with existing systems are numerous. Adams Arms is the only current retro fit piston system that is capable of regulating gas flow to the firearm's operating system. However the Adams arms system is not equipped to precisely regulate gas as would be appropriate to optimize a firearm's performance. Furthermore, the Adams arms gas regulation system is limited to three positions, i.e., partial gas, full gas, and off. Because the system uses a single large aperture for full gas and partially occludes the aperture to achieve partial gas, the caliber and type of ammunition compatibility are unduly restricted. The Adams Arms single aperture design lacks efficiency by excluding a means to precisely meter gas flow. The gas regulator is not easily manipulated under adverse conditions, especially if gloves are worn. In addition, the gas regulator can be accidentally released while moving between settings and there are no options for a low profile gas regulator that would allow the use of an uninterrupted extended hand guard.

The present disclosure offers many advantages over the prior art. More specifically, the presently disclosed gas regular provides up to four positions of adjustment including reduced gas flow, normal gas flow, adverse gas flow, and extra high or no gas flow settings. Each position of adjustment has a precisely sized gas port to optimize performance with or without a silencer and provide the widest range of caliber and ammunition type compatibility. A spring loaded adjustment knob positively locks the regulator in position while its method of actuation and size facilitate rapid manipulation under adverse conditions and while wearing gloves. The gas regulator works by restricting the flow of gas from the host weapons barrel and not by venting excess gas into the atmosphere. The present disclosure offers an alternative low profile gas regulator that may be concealed under the hand guard providing for an uninterrupted extended hand guard for mounting accessories, In addition, the gas regulator can not be accidentally released while in use yet it can be easily retro fitted to existing gas operated firearms. Moreover, the gas regulator may be quickly and easily disassembled for routine maintenance, and can be configured for use with both indirect gas impingement, e.g. piston op-rod, or direct gas impingement, e.g. original AR type, operating systems.

SUMMARY

An adjustable gas regulator for use with a gas operated firearm is disclosed which includes a gas block configured to receive a barrel of a firearm and defining a gas block bore. A gas port is defined within the gas block bore and is positioned to communicate with a gas port aperture of a firearm. A gas regulating cylinder is dimensioned to be rotatably received within the gas block bore. The gas regulating cylinder defines a plurality of cylinder gas ports spaced about the periphery of the cylinder. The gas regulating cylinder is rotatably positioned within the gas block such that the gas regulating cylinder is selectively rotatable to position any one of the cylinder gas ports in communication with the gas port of the bas block bore. In one embodiment, an adjustment knob is secured to one end of the gas regulating cylinder. The adjustment knob is rotatably fixed in relation to the gas regulating cylinder such that rotation of the adjustment knob effects corresponding rotation of the gas regulating cylinder.

In one embodiment, a releasable plug extends through the gas block into engagement with the gas regulating cylinder. The releasable plug is movable from a first position engaged with the gas regulating cylinder to retain the gas regulating cylinder within the gas block bore to a second position to facilitate removal of the gas regulating cylinder from the gas block bore.

In one embodiment, the adjustable gas regulator includes a detent engaged with the plug to retain the plug in the first position.

In one embodiment, the adjustable gas regulator includes a biasing member positioned to urge the detent into engagement with the plug.

In one embodiment, the plug defines a groove which receives one end of the detent and is dimensioned to facilitate movement of the plug between the first and second positions.

In one embodiment, the adjustable gas regulator includes a piston cylinder positioned within a second end of the gas block bore. The piston cylinder defines a bore configured to receive the gas regulating cylinder, wherein the gas regulating cylinder and the piston cylinder define an anti-fouling cavity within the gas block bore.

In one embodiment, the gas block defines a vent channel that communicates with the anti-fouling cavity.

In one embodiment, the adjustment knob includes interlocking structure configured to releasably retain the adjustment knob in a plurality of rotatably fixed positions in relation to the gas block. The adjustment knob may include at least one position stop and the gas block may support structure defining a plurality of notches dimensioned to receive the at least one position stop to rotatably maintain the adjustment knob and the gas regulating cylinder in rotatably fixed positions with respect to the gas block. In one embodiment, the adjustment knob is movable axially from a first position wherein the at least one position stop is received in at least one of the plurality of notches to a second position wherein the at least one position stop is disengaged from the at least one of the plurality of notches, wherein in the second position of the adjustment knob, the adjustment knob and the gas regulating cylinder are rotatable in relation to the gas block. A spring may be positioned to urge the adjustment knob to the first position.

In one embodiment, a bushing is fixedly positioned within the gas block bore and the plurality of notches is formed in one end of the bushing.

In an alternate embodiment, the plurality of notches is formed in one end of the gas block.

The plurality of notches may include four notches and the at least one position stop may include two position stops. Each of the plurality of notches may be spaced 90 degrees from an adjacent notch about its periphery of the gas block or bushing.

In one embodiment, the gas block is a Picatinny-type gas block. Alternately, the gas block may be a low profile gas block.

BRIEF DESCRIPTION OF THE DRAWINGS

Various embodiments of the presently disclosed multi-block gas regulator are disclosed herein with reference to the drawings wherein.

DETAILED DESCRIPTION OF EMBODIMENTS

Figure 1:
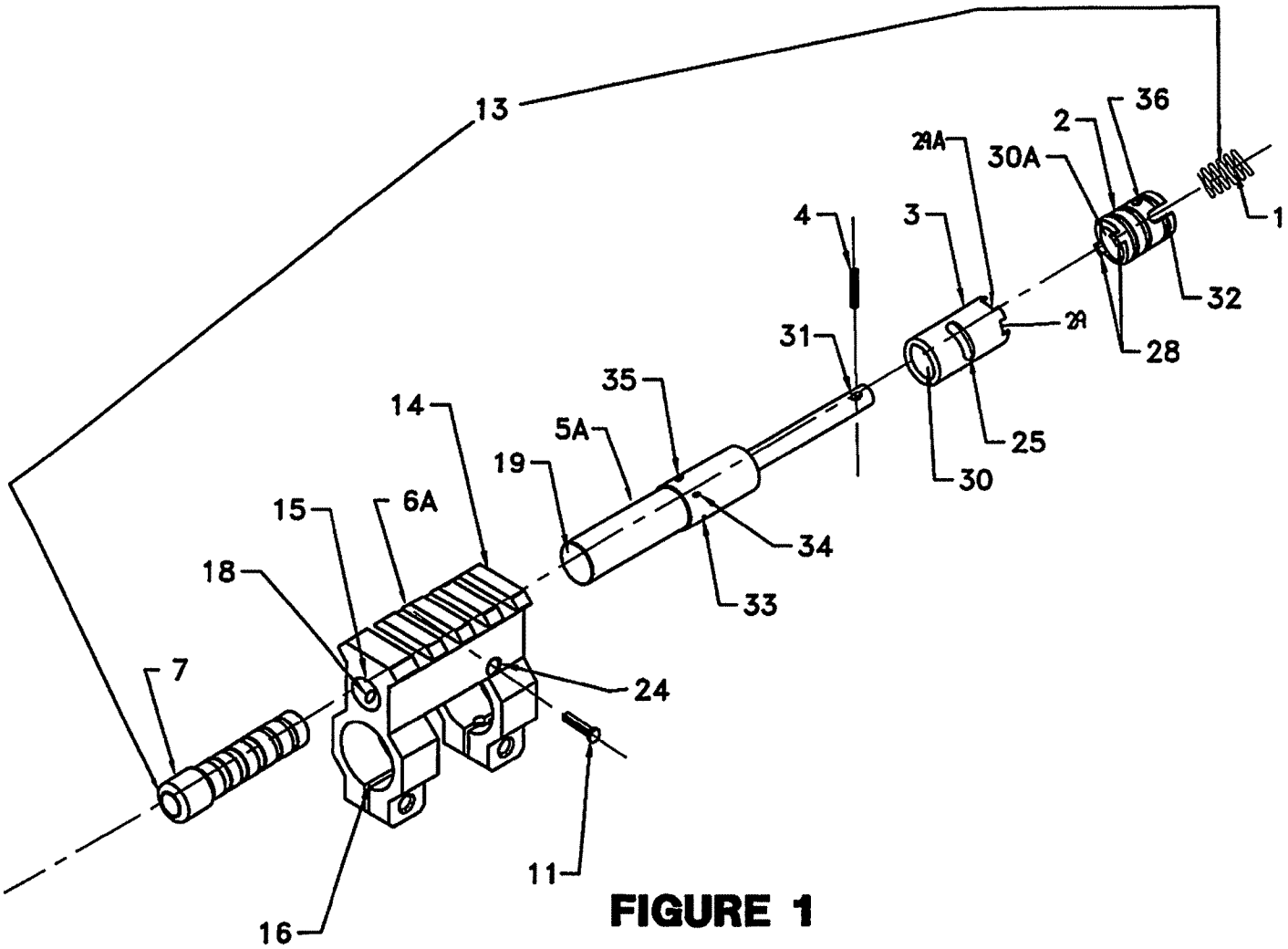
FIG. 1 is an exploded view in perspective of the presently disclosed multi-block gas regulator including with a Picatinny rail type gas block, and removable four position gas regulating cylinder.

Embodiments of the presently disclosed multi-block gas regulator will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and/or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Figure 3:
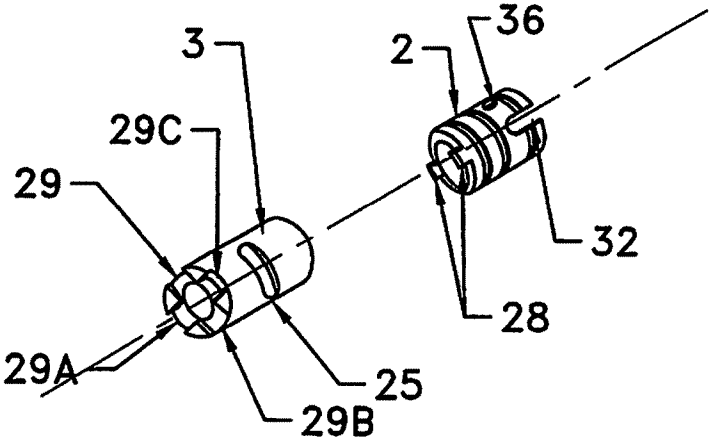
FIG. 3 is a perspective view from the front of the bushing and adjustment knob of the multi-block gas regulator shown in FIG. 1.
Figure 4B:
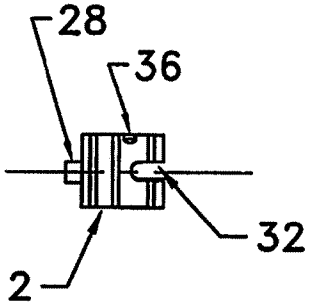
FIG. 4B is a side view of the adjustment knob of FIG. 4.
Figure 4A:
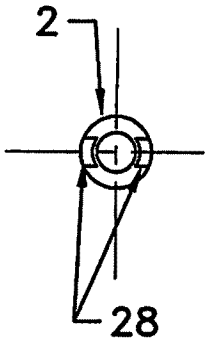
FIG. 4A is a front view of the adjustment knob shown in FIG. 4.
Figure 4:
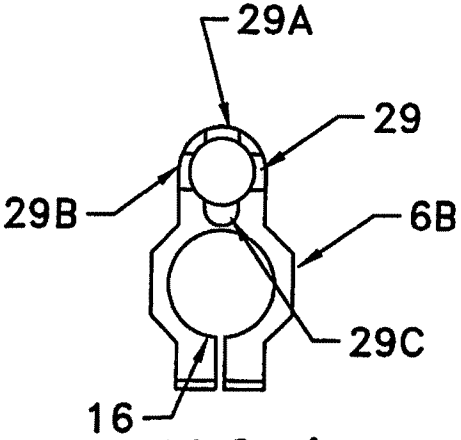
FIG. 4 is a front view of low profile gas block and the adjustment knob of the multi-block gas regular shown in FIG. 1.
Figure 5:
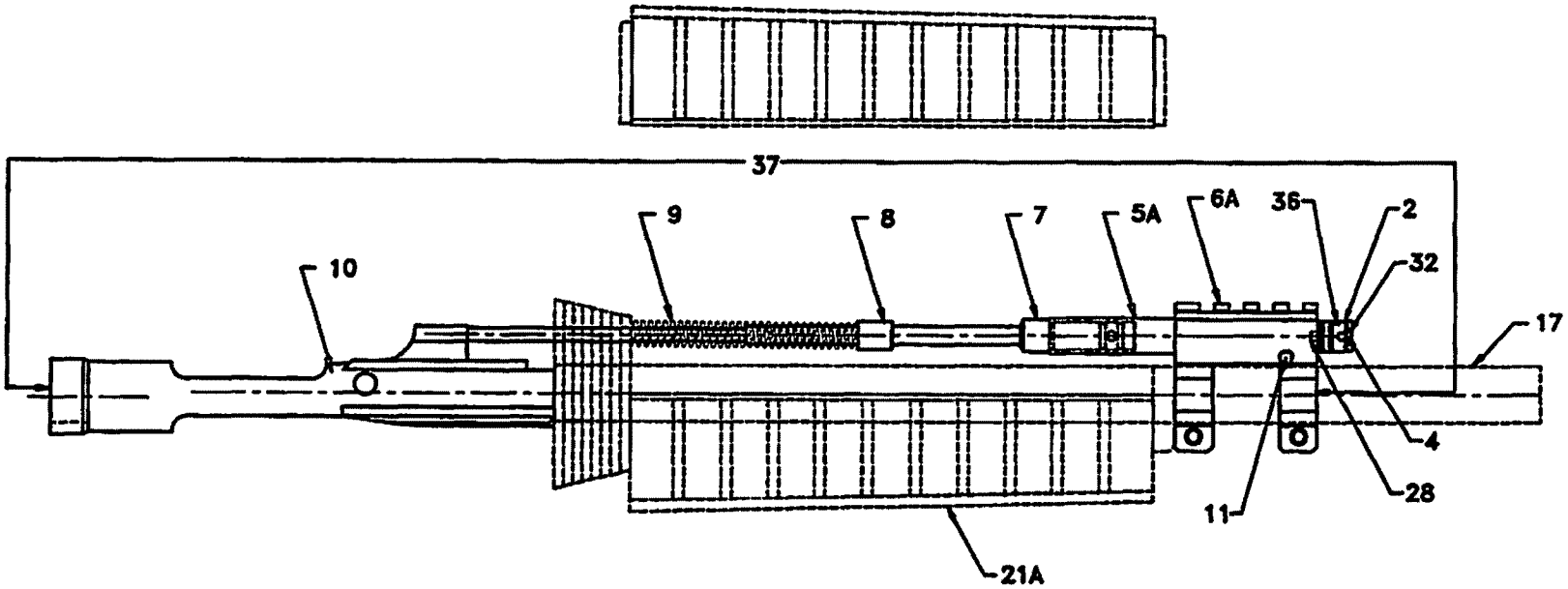
FIG. 5 is a side view of the multi-block gas regulator as shown in FIG. 1 in an assembled state as it would be installed on a firearm.

Exemplary embodiments of the present disclosure are shown in FIGS. 1-9. Looking first at FIGS. 1, 2, and 5, the multi-block gas regulator 13 is shown in an exploded view, with dashed lines indicating the order and way of assembly. The primary parts of the multi-block gas regulator 13 include a Picatinny-type gas block 6A, a gas regulating cylinder 5A, a bushing 3, an adjustment knob 2, a compression spring 1, a split pin 4, a piston 7, and a take down pin 11. In an alternative embodiment shown in FIG. 2, the gas block 6A can be replaced by a low profile gas block 6B which will be discussed in further detail herein below. The gas block 6A forms a rail mounting surface 14 on a top surface of gas block 6A for attaching accessories, e.g., sights, lasers, etc. Two bores extend through the gas block 6A including, a gas regulating cylinder bore 15 and a barrel bore 16. The gas regulating cylinder bore 15 is configured to receive the gas regulating cylinder 5A and the barrel bore 16 is configured to receive a barrel of a firearm 17 as shown in FIG. 5. The gas regulating cylinder 5A or 5B has a piston bore 19 which is configured to slidably receive a piston 7. FIG. 5 shows the multi-block gas regulator as it would be assembled on a firearm with additional parts including an op-rod 8, a return spring 9 and a bolt carrier 10.

Figure 2:
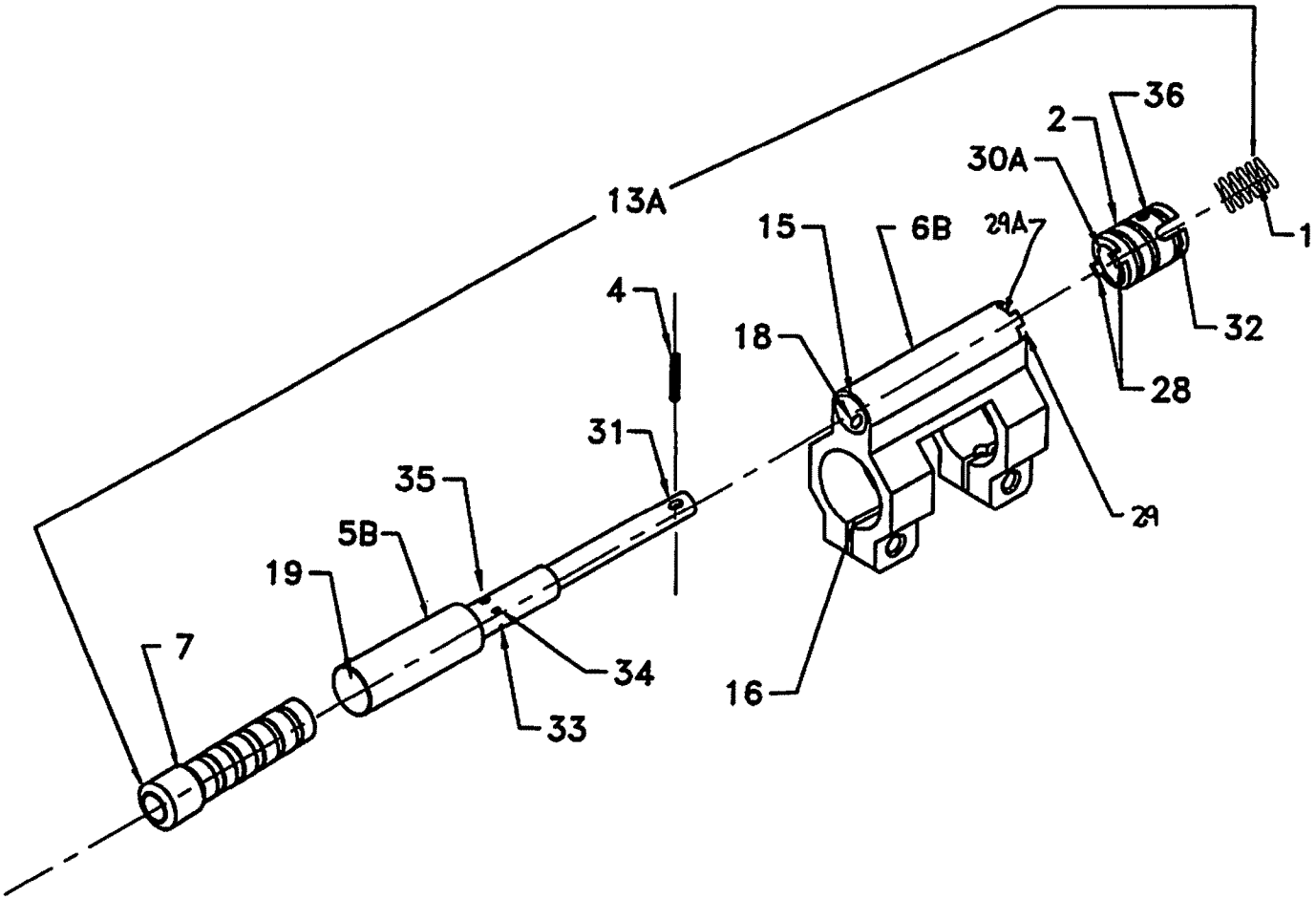
FIG. 2 is an exploded view in perspective of the presently disclosed multi-block gas regulator including a low profile gas block, and four position gas regulating cylinder.
Figure 7:
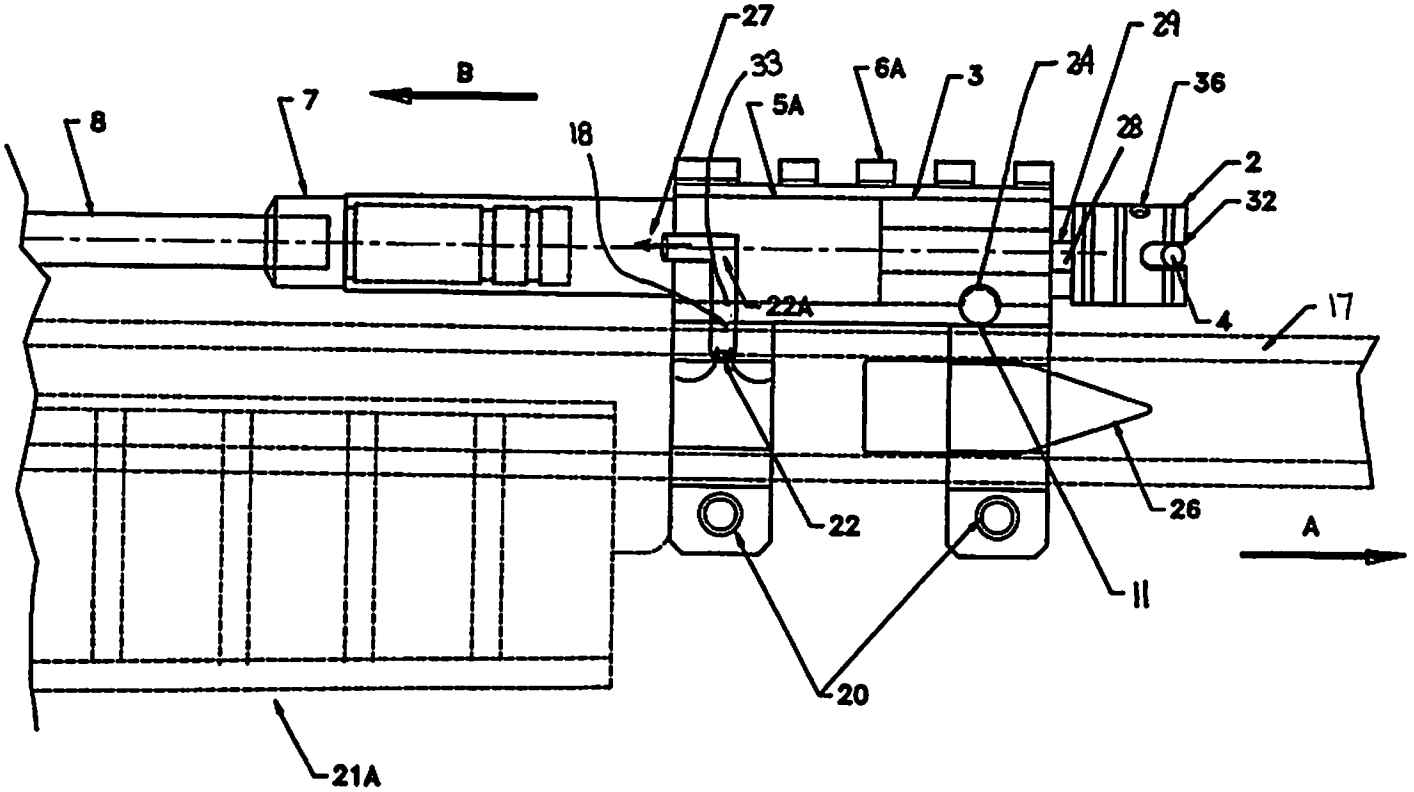
FIG. 7 is a side view of the fully assembled multi-block gas regulator illustrating internal details of the gas regulating system.

Referring to FIGS. 1, 2, and 7, a barrel 17 of a rifle defines a gas port aperture 22 which communicates with the gas block gas port 18 within gas regulating cylinder bore 15 of gas block 6A or 6B. Gas block gas port 18 communicates with the gas regulating cylinder 5A or 5B.

As discussed above, gas block 6A includes barrel bore 16 which is dimensioned to receive barrel 17 of a rifle. Clamping screws 20 are provided to fixedly secure gas block 6A to barrel 17. Referring also to FIG. 5, gas block 6A defines a retaining pin hole 24 which is aligned with a retaining pin slot 25 formed in bushing 3. A retaining pin 11 is dimensioned to be received through retaining pin hole 24 in gas block 6A or 6B and retaining pin slot 25 in bushing 3 to secure gas regulating cylinder 5A within gas block 6A or 6B. The regulating cylinder 5A is configured with three gas ports 33, 34, 35 of various sizes spaced apart, e.g., 90 degrees, about its periphery.

Bushing 3 and adjustment knob 2 are configured with a thru-bore 30 and 30A, respectively, to receive the narrow end of the regulating cylinder 5A. Bushing 3 has four index notches 29-29C (FIG. 4) positioned 90 degrees apart on its periphery. Index notches 29-29C are positioned to selectively interlock with position stops 28 that are positioned 180 degrees apart on the periphery of adjustment knob 2. Alternately, other configuration of stops and notches on knob 2 and bushing 3 may be provided to releasably secure knob 2 to bushing 3. Bushing 3 and adjustment knob 2 are secured to the regulating cylinder 5A with split pin 4 that traverses U-notches 32 of the adjustment knob 2 and is affixed within split pin bore 31. Adjustment knob 2 is maintained in interlocked relation with bushing 3 under compressive force of compression spring 1 which is captured between a shoulder or rim (not shown) defined at one end of adjustment knob 2 and split pin 4. Spring 1 urges adjustment knob 2 towards bushing 3 to position stops 28 in selected ones of notches 29-29C to rotatably secure knob 2 in relation to bushing 3. The adjustment knob 2 has a position aperture or indicator 36 that aligns with index notches 29, 29A, 29B, 29C of bushing 3 to provide a visual indication of the selected gas setting of the multi-block gas regulator as will be described in further detail below.

Figure 6:
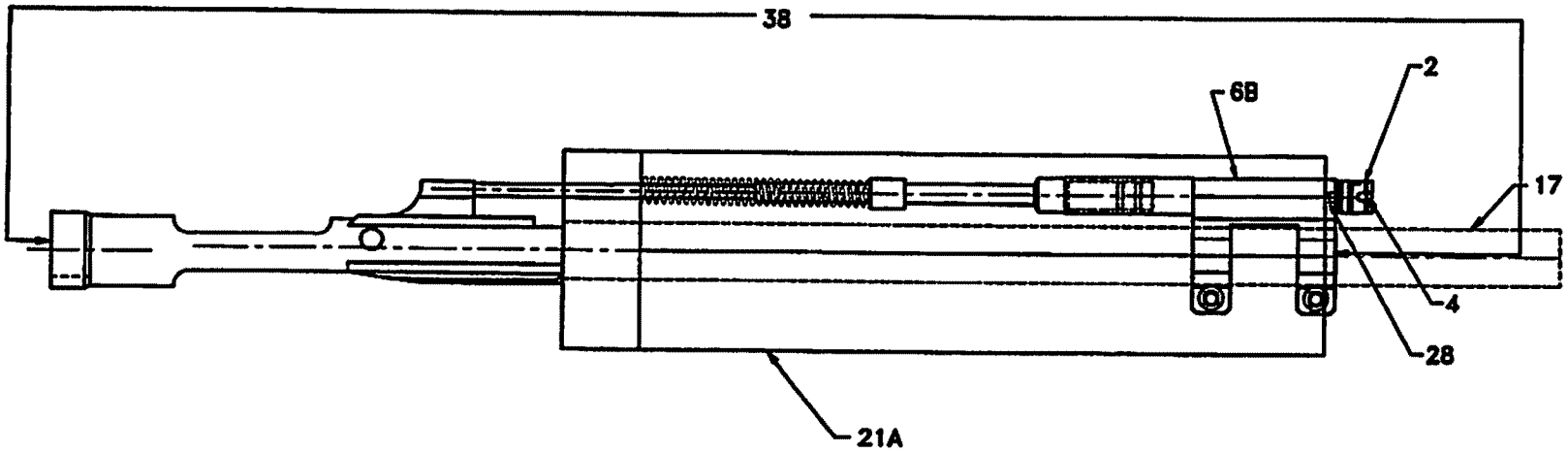
FIG. 6 is a side view of the multi-block gas regulator shown in FIG. 2 illustrating how the low profile gas block is fully concealed by the firearm's hand guard.

FIG. 6, is a side view of the multi-block gas regulator 13A shown in FIG. 2 illustrating the low profile gas block 6B fully concealed by the firearm's hand guard 21A. FIG. 6 also illustrates how the adjustment knob 2 is positioned forward of the hand guard 21A allowing easy access to the adjustment knob 2.

Referring to FIG. 7, when a round is fired, a bullet 26 is propelled by discharge gases 27 located behind bullet 26 muzzleward, in the direction indicated by arrow "A". When the bullet 26 passes over the gas port aperture 22 of barrel 17 of a firearm, a portion of the discharge gases 27 is directed through gas port aperture 22 and into the gas regulating cylinder passage 22A of gas block 6A. As the discharge gases 27 enter the gas regulating cylinder 5A, the gases exert a force that actuates a firearm's operating system. U.S. Pat. No. 8,689,672 discloses a gas operating system such as shown in FIG. 6 and is incorporated herein in its entirety by reference.

Referring to FIGS. 1, 3, and 7, gas flow into a firearm's operating system is traditionally set by the manufacturer and is determined by the size of the gas port aperture 22 created in the barrel 17 of the firearm. The multi-block gas regulator 13 of the present disclosure adjustably regulates the amount of gases permitted to flow into the firearm's operating system by selectively positioning one of gas ports 33-35 in communication with gas port aperture 22. More specifically, when adjustment knob 2 is rotated split-pin 4, which is positioned through U-notches 32 of adjustment knob 2 and through split-pin bore 31 of regulating cylinder 5A, is also rotated to effect corresponding rotation of regulating cylinder 5A. Position aperture or indicator 36 is selectively positionable, by rotating adjustment knob 2, to be aligned with any one of index notches 29-29C. More specifically, when the adjustment knob 2 is positioned to align indicator 36 with index notch 29 regulating cylinder 5A is positioned to align gas port 33 in communication with gas port aperture 22 of gas block 6A which communicates with gas port aperture 22 of barrel 17 of a firearm. In one embodiment, gas port 33 is dimensioned to restrict the flow of discharge gas 27 to an optimum level to run a silencer. With further rotation of adjustment knob 2 to align position aperture 36 with index notch 29A, gas port 34 is positioned in communication with gas port aperture 22 which allows an optimal flow of discharge gas 27 to cycle the host firearm without a silencer and under normal conditions. With further rotation of adjustment knob 2 to align position aperture 36 with index notch 29B, gas port 35 is positioned in communication with gas port aperture 22 which allows an extra flow of discharge gas 27 to cycle the host firearm without a silencer and under adverse conditions. Lastly a further rotation of adjustment knob 2 to align position aperture 36 with index notch 29C takes gas port 33, 34, and 35 out of communication with gas port aperture 22 shutting off the flow of discharge gas 27 to the host firearm operation system. Although the presently disclosed multi-block gas regulator is disclosed to have four distinct gas settings, it is envisioned that two or more gas settings may be provided, e.g., three, four, five, six, etc.

Referring to FIGS. 1, 3, and 7, the rotational position of regulating cylinder 5A within gas block 6A, and thus, the gas settings are maintained by an interlocking mechanism defined by the four index notches 29, 29A, 29B, 29C of bushing 3 and adjustment knob's 2 two position stops 28. Pulling muzzleward on the adjustment knob 2 moves adjustment knob 2 muzzleward against the urging of spring 1 to release the position stops 28 from the index notches 29, 29A, 29B, 29C allowing rotation of the regulating cylinder 5A, thus changing the gas setting. Aligning the position aperture 36 with any one of the index notches 29, 29A, 29B, 29C and releasing the adjustment knob 2 again interlocks the position stops 28 within the index notches 29, 29A, 29B, 29C preventing rotation of the regulating cylinder 5A, thus securing the selected gas setting. More specifically, when position aperture 36 is aligned with a selected index notch 29-29C by rotating adjustment knob 2 and, thereafter, released, spring 1 urges adjustment knob 2 towards bushing 3 to locate position stops 28 into selected index notches 29-29C to releasably lock adjustment knob 2 and regulating cylinder 5A at a rotatably fixed position. Because regulating cylinder 5A is rotatably fixed to adjustment knob 2 by split-pin 4, regulating cylinder 5A is maintained in a rotatably fixed position within gas block 6A, 6B.

Referring to FIG. 4, low profile gas block 6B is configured with four index notches 29, 29A, 29B, 29C, which correspond tro the index notches on bushing 3. The adjustment knob 2 and position stops 28 of adjustment knob 2 interface with the four index notches 29, 29A, 29B, 29C of the low profile gas block 6B in the same way the notches 29-29C of bushing 3 interface with the adjustment knob 2 and position stops 28 to provide the same means for selectively adjusting and maintaining the gas settings.

Figure 8:
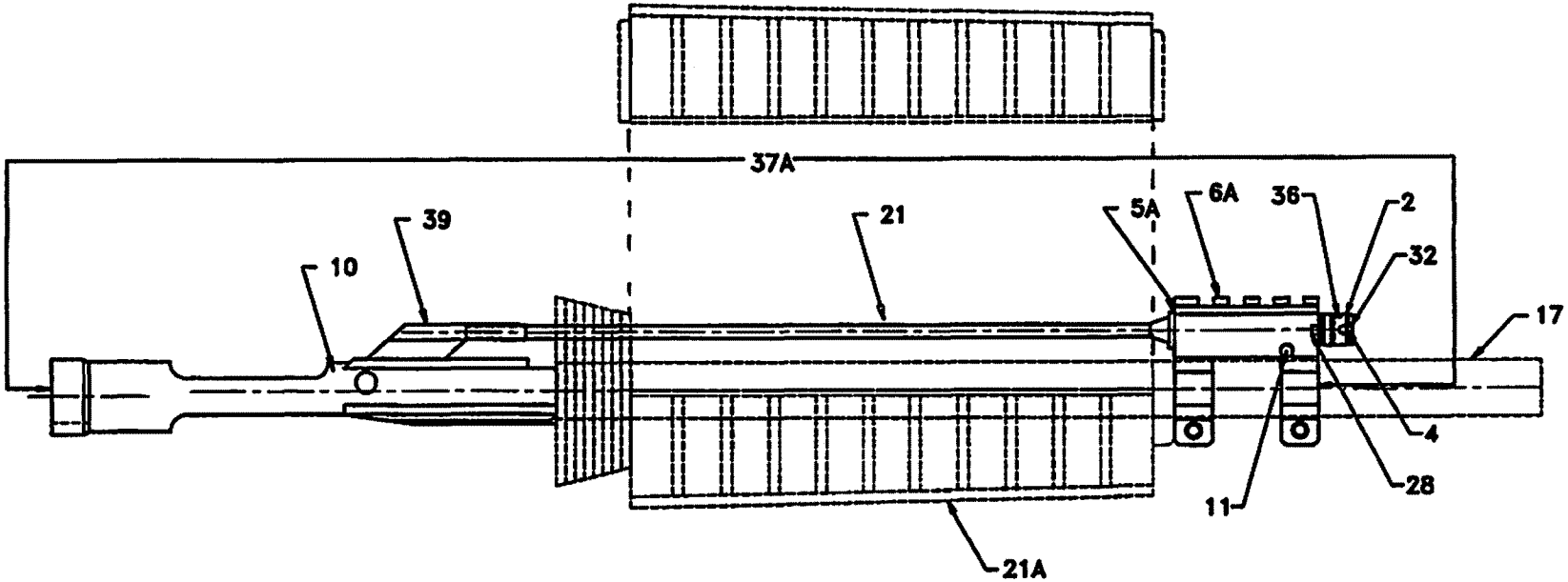
FIG. 8 is a side view of the presently disclosed multi-block gas regulator shown in FIG. 1, illustrating how the Picatinny type gas block with removable four position gas regulating cylinder shown in FIG. 1 can be configured with a gas tube so as to be utilized by a direct gas impingement firearm.
Figure 9:
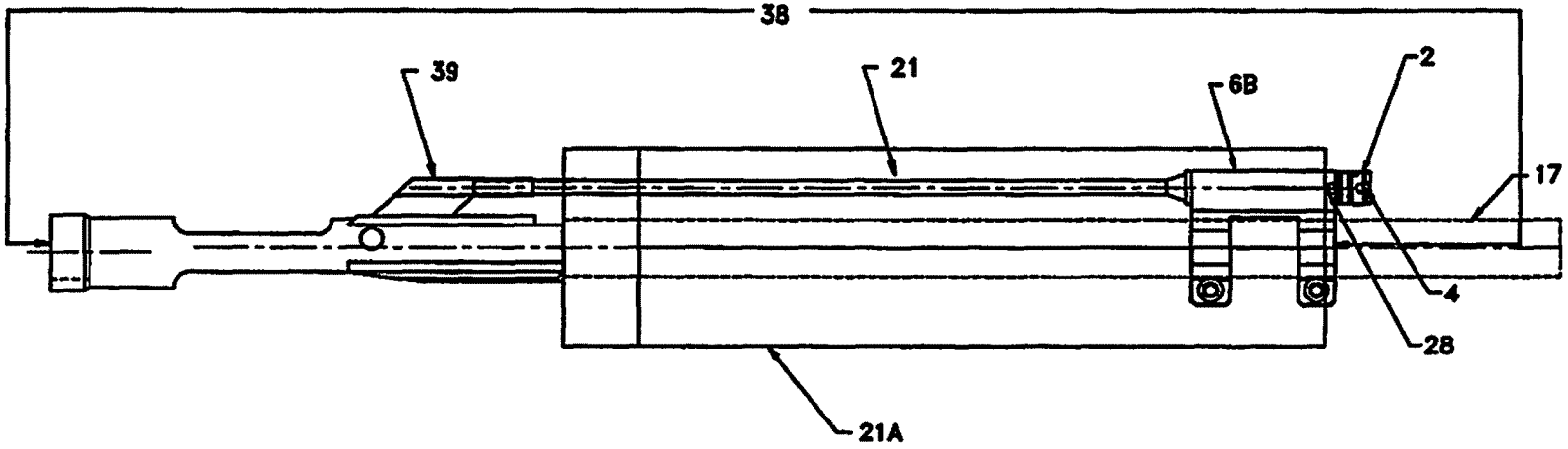
FIG. 9 is a side view of the presently disclosed multi-block gas regulator illustrating how the low profile gas block with four position gas regulating cylinder shown in FIG. 2 can be configured with a gas tube so as to be utilized by a direct gas impingement firearm.

Referring to FIGS. 8 and 9, the multi-block gas regulator may be configured with a gas tube 21 for utilization with a direct gas impingement operating system, e.g. AR-15/AR-10 family of firearms. More specifically, in FIGS. 8 and 9, the piston 7, op-rod 8 and return spring 9 in FIG. 5 are replaced by a gas tube 21. Referring to FIGS. 5, 7, 8, and 9, the multi-block gas regulator 37 and 38 directs discharge gas 27 through the regulating cylinder 5A to act upon a piston 7 causing the firearm's action to cycle. In comparison the multi-block gas regulator 37A and 38A in FIGS. 8 and 9 directs discharge gas 27 through the regulating cylinder 5A and gas tube 21 into a bolt carrier gas key 39 causing the firearm's action to cycle. Otherwise all the operational characteristic of the multi-block gas regulator 37, 38 and the gas tube configured multi-block gas regulator 37A (38A) are identical.

FIGS. 10-14 illustrate another embodiment of the presently disclosed gas block regulator system shown generally as 100. System 100 is similar to the gas block regulator 10 described above but includes features to allow for expedited disassembly to facilitate cleaning.

Figure 10:
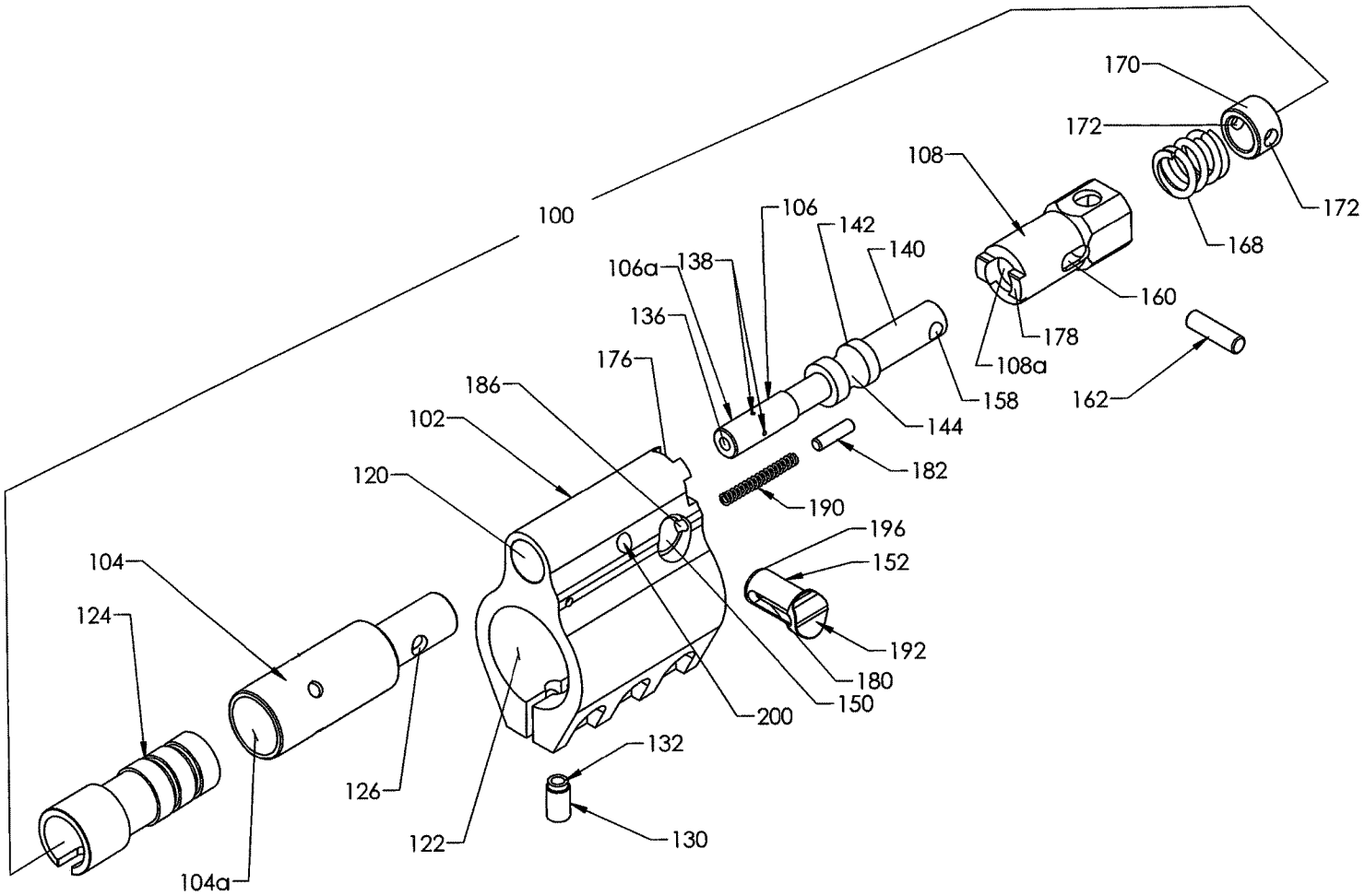
FIG. 10 is an exploded, perspective view of another embodiment of the presently disclosed multi-block gas regulator system.
Figure 12:
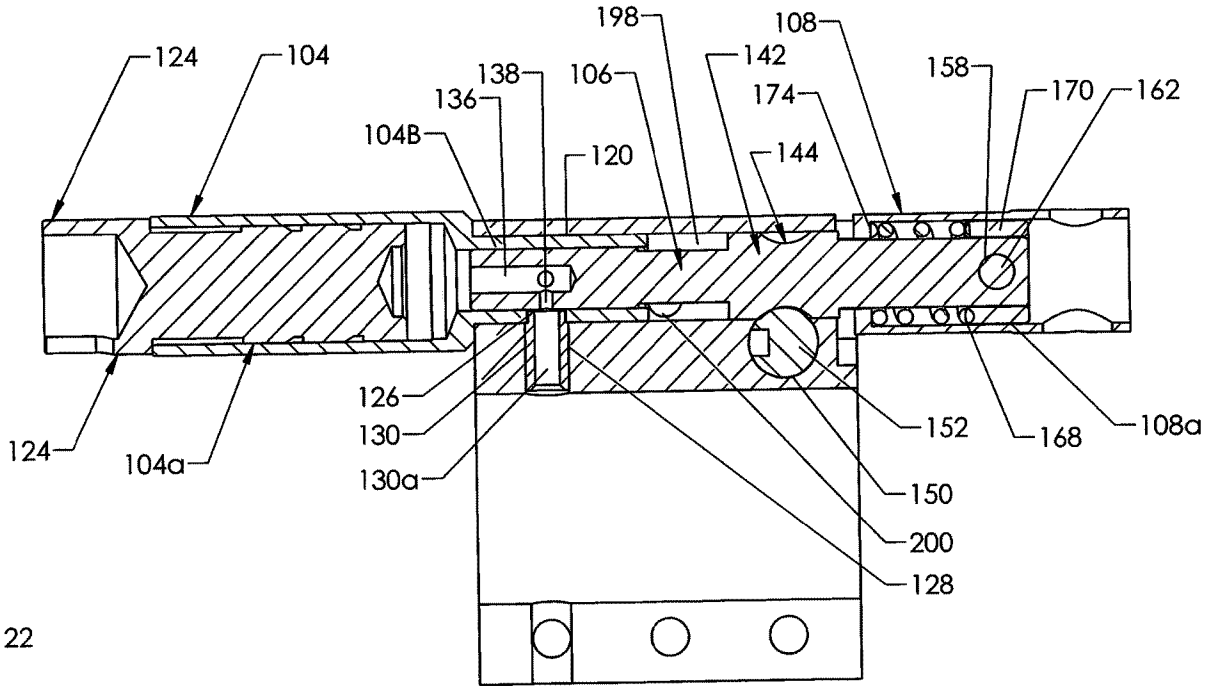
FIG. 12 is a cross-sectional view along section line 12-12 of FIG. 11.

Referring to FIG. 10, the system 100 includes a gas block 102 (which may be a low profile gas block as shown or a Picatinny-type gas block as described above with reference to FIG. 1), a piston cylinder 104, a gas regulator 106, and a regulator knob 108. The gas block 102 defines two bores including a gas regulating cylinder bore 120 and a barrel bore 122. The gas regulating cylinder bore 120 is configured to receive one end of the piston cylinder 104 and the barrel bore 122 is configured to receive a barrel 17 of a firearm (FIG. 5). The piston cylinder 104 has a stepped configuration having a first end defining a first piston bore 104*a* which is configured to slidably receive a piston 124 and a second end defining a second piston bore 104*b* (FIG. 12). The second piston bore 104*b* is configured to receive one end of the gas regulator 106 as will be discussed in further detail below. The piston 124 is operatively connected to the operating system of a firearm as discussed above.

Figure 11:
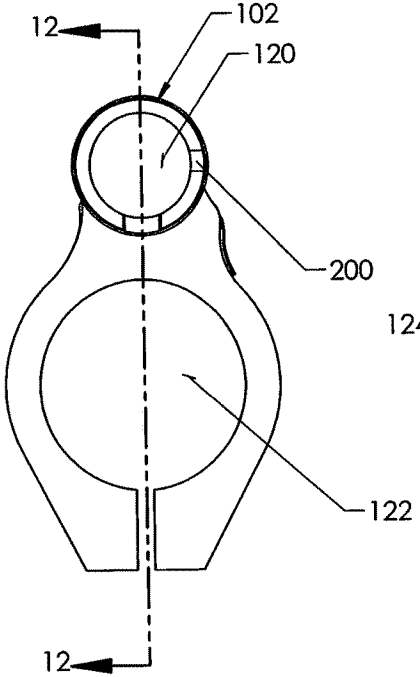
FIG. 11 is a front view of the gas block of the multi-block gas regulator of FIG. 10.

Referring also to FIGS. 11 and 12, the piston cylinder 104 defines a throughbore 126 that communicates with the second piston bore 104*b*. The gas block 102 also defines a throughbore 128 (FIG. 12) that extends between barrel bore 122 and the cylinder bore 120. A hollow plug 130 defining a channel 130*a* is positioned within the throughbore 128 of the gas block 102 and includes a nipple 132 that extends into the throughbore 126 of the piston cylinder 104 to secure the piston cylinder 104 within the cylinder bore 120 of the gas block 102. The plug 130 defines a gas channel 130*a* that extends between the barrel bore 122 of the gas block 102 and the cylinder bore 120 of the gas block 102 such that the channel 130*a* communicates with the bore 136 of the gas regulator 106 as discussed below.

A first end 106*a* of the gas regulator 106 is dimensioned to be received in the second piston bore 104*b* of the piston cylinder 104. The gas regulator 106 defines a bore 136 and a series of gas ports 138 (such as described above with regard to gas ports 33-35) that are positioned about the periphery of the gas regulator 106. Each of the gas ports 138 can be selectively moved into communication with the channel 130*a* defined by the plug 130 by rotating the gas regulator 106 within the second piston bore 104*b* to communicate the throughbore 128 of the gas block 102 with the bore 136 of the gas regulator 106. It is envisioned that the hollow plug 130 need not be provided and that the throughbore 128 of the gas block 102 can communicate with the second piston bore 104*b* of the piston cylinder 104 via the throughbore 126 of the piston cylinder 104. In such an embodiment, the piston cylinder 104 can be secured within the cylinder bore 120 of the gas block 102 using any known fastening technique, e.g., welding, swaging, etc.

The gas regulator 106 includes a second end 140 and a central portion 142. The central portion 142 defines an annular concavity 144 that is received in the end of the throughbore 120 of the gas block 102 opposite to the piston cylinder 104. The gas block 102 defines a transverse bore 150 that is aligned with the annular concavity 144 of the gas regulator 106 when the gas regulator 106 is positioned within the bore 120 of the gas block 102. The transverse bore 150 extends through the gas block 102 and is dimensioned to receive a releasable plug 152, as will be discussed in further detail below, to releasably secure the gas regulator 106 within the bore 120 of the gas block 102.

The second end 140 of the gas regulator 106 defines a transverse throughbore 158 and extends from the bore 120 of the gas block 102. The regulator knob 108 is hollow and defines axialy elongated slots 160 that are aligned with the transverse throughbore 158 of the gas regulator 106 when the gas regulator 106 is positioned in the gas block 102. The regulator knob defines a bore 108*a* that receives the second end 140 of the gas regulator 106. A pin 162 extends through the slots 160 of the regulator knob 108 and the transverse throughbore 158 of the gas regulator 106 to secure the regulator knob 108 to the gas regulator 106. The elongated slots 160 facilitate longitudinal movement of the regulator knob 108 in relation to the gas regulator 106.

In embodiments, a tubular liner 170 is secured within an end of the bore 108*a* of the regulator knob 108 opposite to the gas block 102. The liner 170 defines diametrically opposed openings 172 that receive the pin 162 to secure the liner within the regulator knob 108. The liner 170 receives the end of the gas regulator 106 to stabilize the gas regulator 106 and regulator knob 108 assembly. A spring 168 is positioned within the bore 108*a* of the regulator knob 108 between the liner and a distal shoulder 174 of the gas regulator knob to urge the gas regulator knob 108 in a direction towards the gas block 102.

The end of the regulator knob 108 adjacent to the gas block 102 includes a plurality of notches 176. The notches 176 are configured to receive at least one finger or stop, e.g., two stops 178, formed on the end of the regulator knob 108. As discussed above, the spring 168 is positioned to urge the regulator knob 108 towards the gas block 102 such that the stops 178 are received within selected notches 176 to secure the gas regulator knob and thus, the gas regulator 106 in one of a plurality of fixed rotational positions within the cylinder bore 120 of the gas block 102. As discussed above with regard to the gas regulator, the regulator knob 108 is operable to rotate the gas regulator 106 within the cylinder bore 120 of the gas block to align a selected one of the gas ports 138 with the channel 130*a*.

Figure 13:
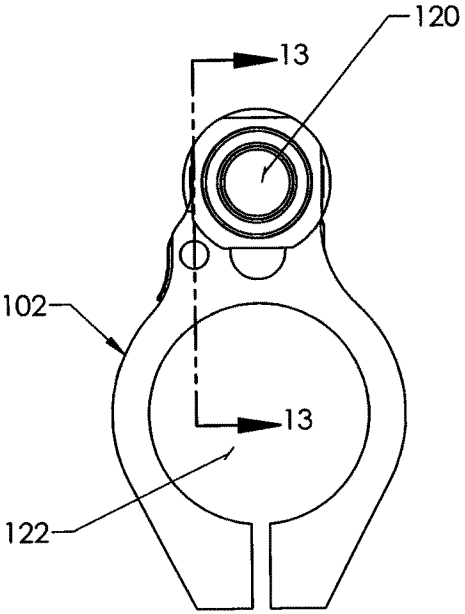
FIG. 13 is a rear view of the gas block of the multi-block gas regulator of FIG. 10.
Figure 14:
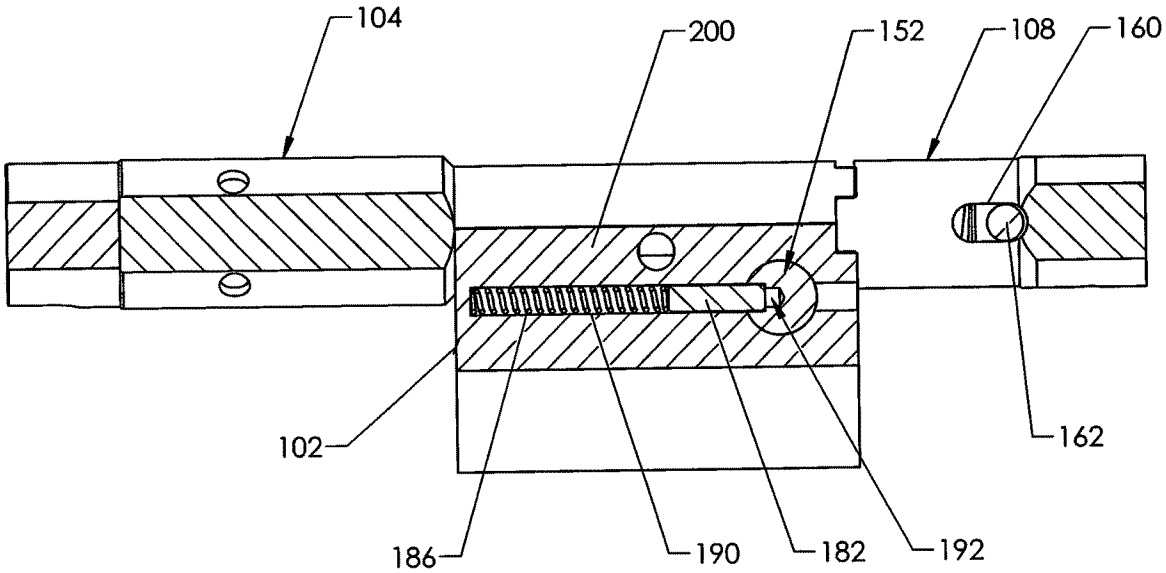
FIG. 14 is a cross-sectional view taken along section lines 14-14 of FIG. 13.

Referring also to FIGS. 13 and 14, the releasable plug 152 is slidably received in the transverse bore 150 of the gas block 102 and the annular concavity 144 of the gas regulator 106 to rotatably secure the gas regulator 106 within the gas block 102. The releasable plug 152 has a groove 180 formed therein. The groove 180 is dimensioned to receive a detent 182 that is slidably received within an axial bore 186 (FIG. 14) formed in the gas block 102 such that the releasable plug 152 is retained within the transverse bore 150. As discussed above, the releasable plug 152 rotatably secures the gas regulator 106 within the cylinder bore 120 of the gas block 102.

The detent 182 is biased into the groove 180 by a biasing member 190 that is into positioned within the axial bore 186 of the gas block 102. One end of the releaseable plug 152 includes a head 192 which prevents movement of the releasable plug 152 through the transverse bore 150. The other end 196 (FIG. 10) of the releaseable plug 152 is sized to pass through the transverse bore 150. As such, the end 196 of the plug 152 can be pressed with, for example, a round of ammunition, to overcome the force of the biasing member 190 to disengage the detent 182 from the groove 180 and force the plug 152 to a position disengaged from the annular concavity 144 of the gas regulator 106 to facilitate removal of the gas regulator 106 from the cylinder bore 120 of the gas block 102. It is noted that because the groove 180 does not extend the entire length of the plug 152, the plug 152 will not become disengaged from the gas block 102, i.e., positioning of the detent 180 within the groove will secure the plug 152 to the gas block 102.

In use, the gas regulator 106 can be selectively rotated within the cylinder bore 120 of the gas block 102 to align a gas port 138 of a plurality of gas ports 138 with the channel 130*a* of the plug 130 to control gas flow into the piston cylinder 104. The gas regulator 106 can be rotated within the cylinder bore 120 of the gas block 102 by pushing forward on the regulator knob 108 to compress the biasing member 168 and move the regulator knob 108 away from the gas block 102. As the regulator knob 108 moves away from the gas block 102, the stops 178 are disengaged from the notches 176 to facilitate rotation of the gas regulator 106 in relation to the gas block 102. When the selected gas port 138 is aligned with the channel 130*a* of the plug 130, the regulator knob 108 can be released by the operator such that the spring 168 moves the regulator knob 108 back towards the gas block 102 to reposition the stops 178 within the notches 176.

As discussed above with regard to multi-gas regulator block 13, the gas ports 138 can be sized to restrict the flow of discharge gas to an optimum level to run a silencer, to cycle the host firearm without a silencer and under normal conditions, to allow an extra flow of discharge gas to cycle the host firearm without a silencer and under adverse conditions and to take the gas ports 38 out of communication with channel 130*a* to shut off the flow of discharge gas to the host firearm operation system. It is envisioned that two or more gas settings may be provided, e.g., three, four, five, six, etc.

Referring again to FIG. 12, in the current embodiment of the multi-gas block regulator 100, an anti-fouling cavity 198 is defined between the central portion 142 of the gas regulator 106 and the end of the piston cylinder 104. The anti-fouling cavity 198 communicates with the atmosphere through a vent hole 200 formed through the gas block 102. The anti-fouling cavity 198 and the vent hole 200 allow combustion gases that travel between the gas regulator 106 and the piston cylinder 104*b* to escape from the gas regulator 100 to minimize carbon deposits within the firearm. In addition, the anti-fouling cavity is easily accessible upon disassembly of the regulator system 100 to facilitate cleaning of the cavity.

Figure 15:
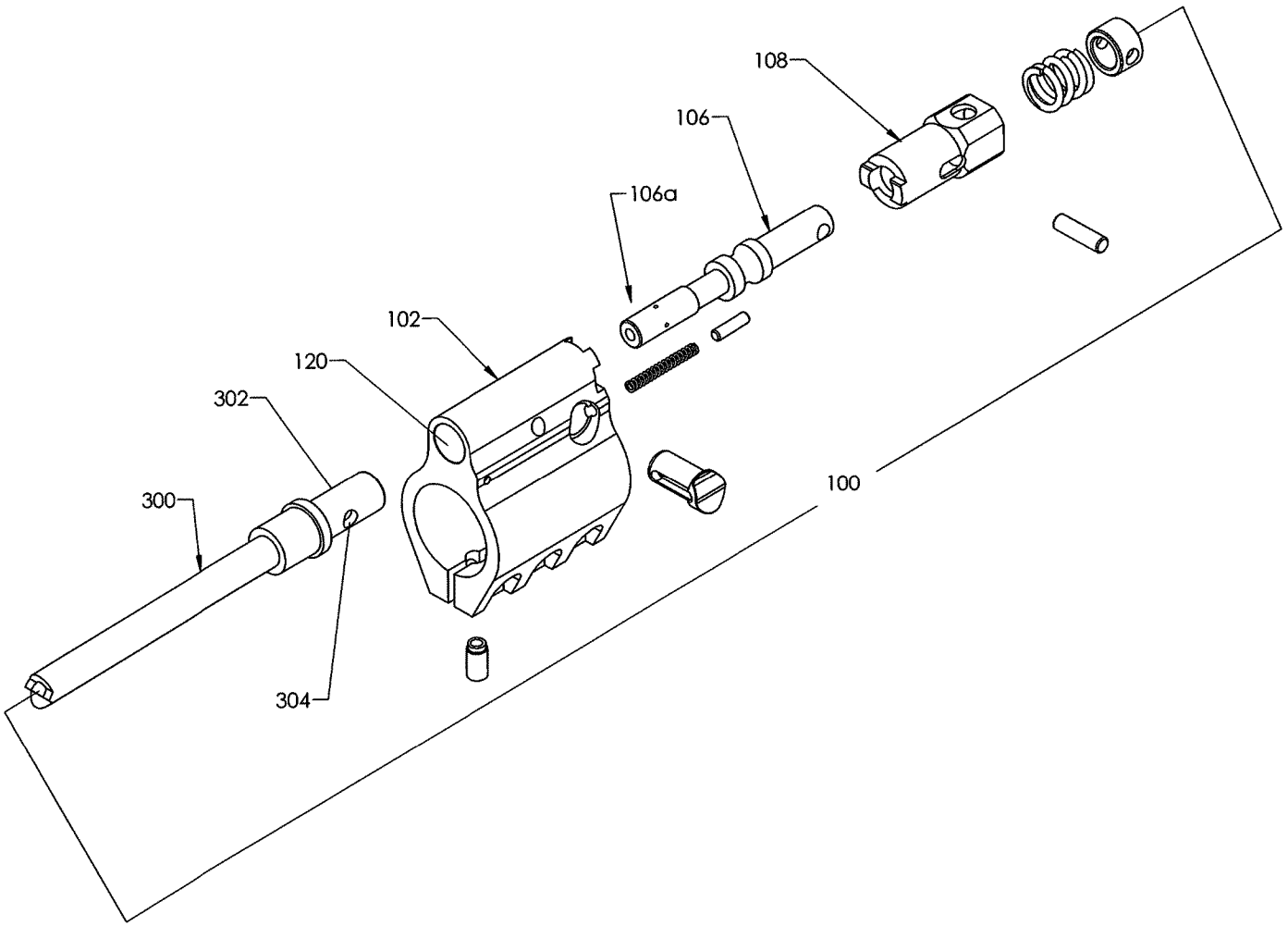
FIG. 15 is an exploded view of the presently disclosed gas regulator system shown in FIG. 10 in association with a gas-tube operating system.

Referring to FIG. 15, the presently disclosed gas block regulator system 100 including gas block 102, the gas regulator 106, and the regulator knob 108 may be used with a gas tube operating system including a gas tube 300. In use, one end 302 of the gas tube 300 is received in the gas regulating cylinder bore 120 of the gas block 102. The end 302 of the gas tube 300 defines a bore 304 that receives the nipple 132 of the plug 130 to secure the gas tube 300 within the cylinder bore 120. Although not shown, the end 302 of the gas tube 300 defines a longitudinal bore that receives the first end 106*a* of the gas regulator 106.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the system based on the above-described embodiments. Accordingly, the present disclosure is not to be limited by what has been particularly shown and described, except as indicated by the appended claims.

What is claimed is:

1. An adjustable gas regulator for use with a gas operated firearm, the adjustable gas regulator comprising:

a gas block configured to receive a barrel of a firearm and defining a gas block bore;

a gas port defined within the gas block bore, the gas port being positioned to communicate with a gas port aperture of a firearm;

a gas regulating cylinder dimensioned to be rotatably received within a first end of the gas block bore, the gas regulating cylinder defining a plurality of cylinder gas ports spaced about the periphery of the cylinder, wherein the gas regulating cylinder is rotatably positioned within the gas block such that the gas regulating cylinder is selectively rotatable to position any one of the cylinder gas ports in communication with the gas port of the gas block bore;

a piston cylinder fixedly secured within a second end of the gas block bore;

a piston positioned within the piston cylinder;

a releasable plug extending through the gas block into engagement with the gas regulating cylinder, the releasable plug being movable from a first position engaged with the gas regulating cylinder to retain the gas regulating cylinder within the gas block bore to a second position to facilitate removal of the gas regulating cylinder from the gas block bore without facilitating removal of the piston and the piston cylinder from the gas block bore;

a detent engaged with the plug to retain the plug in the first position; and a biasing member positioned to urge the detent into engagement with the plug.

2. The adjustable gas regulator of claim 1, wherein the plug defines a groove which receives one end of the detent, the groove being dimensioned to facilitate movement of the plug between the first and second positions.

3. An adjustable gas regulator for use with a gas operated firearm, the adjustable gas regulator comprising:

a gas block configured to receive a barrel of a firearm and defining a gas block bore;

a gas port defined within the gas block bore, the gas port being positioned to communicate with a gas port aperture of a firearm;

a gas regulating cylinder dimensioned to be rotatably received within a first end of the gas block bore, the gas regulating cylinder defining a plurality of cylinder gas ports spaced about the periphery of the cylinder, wherein the gas regulating cylinder is rotatably positioned within the gas block such that the gas regulating cylinder is selectively rotatable to position any one of the cylinder gas ports in communication with the gas port of the gas block bore;

a piston cylinder fixedly secured within a second end of the gas block bore;

a piston positioned within the piston cylinder;

a releasable plug extending through the gas block into engagement with the gas regulating cylinder, the releasable plug being movable from a first position engaged with the gas regulating cylinder to retain the gas regulating cylinder within the gas block bore to a second position to facilitate removal of the gas regulating cylinder from the gas block bore without facilitating removal of the piston and the piston cylinder from the gas block bore; and a piston cylinder positioned within a second end of the gas block bore, the piston cylinder defining a bore configured to receive the gas regulating cylinder, wherein the gas regulating cylinder and the piston cylinder define an anti-fouling cavity about the gas regulating cylinder within the gas block bore.

4. The adjustable gas regulator of claim 3, wherein the gas block defines a vent channel that communicates with the anti-fouling cavity.

5. The adjustable gas regulator according to claim 1, further including an adjustment knob secured to one end of the gas regulating cylinder, the adjustment knob being rotatably fixed in relation to the gas regulating cylinder such that rotation of the adjustment knob effects corresponding rotation of the gas regulating cylinder.

6. The adjustable gas regulator according to claim 1, wherein the adjustment knob includes interlocking structure configured to releasably retain the adjustment knob in one of a plurality of rotatably fixed positions in relation to the gas block.

7. The adjustable gas regulator according to claim 6, wherein the adjustment knob includes at least one position stop and the gas block supports structure defining a plurality of notches dimensioned to receive the at least one position stop to rotatably maintain the adjustment knob and the gas regulating cylinder in rotatably fixed positions with respect to the gas block.

8. The adjustable gas regulator according to claim 7, wherein the adjustment knob is movable axially from a first position wherein the at least one position stop is received in at least one of the plurality of notches to a second position wherein the at least one position stop is disengaged from the at least one of the plurality of notches, wherein in the second position of the adjustment knob, the adjustment knob and the gas regulating cylinder are rotatable in relation to the gas block.

9. The adjustable gas regulator according to claim 8, further including a spring positioned to urge the adjustment knob to the first position.

10. The adjustable gas regulator according to claim 9, further including a bushing fixedly positioned within the gas block bore.

11. The adjustable gas regulator according to claim 10, wherein the plurality of notches are formed in one end of the bushing.

12. The adjustable gas regulator according to claim 10, wherein the plurality of notches are formed in one end of the gas block.

13. The adjustable gas regulator according to claim 8, wherein the plurality of notches includes four notches and the at least one position stop includes two position stops.

14. The adjustable gas regulator according to claim 13, wherein each of the plurality of notches is spaced 90 degrees from an adjacent notch.

15. The adjustable gas regulator according to claim 1, wherein the gas block is a Picatinny-type gas block.

16. The adjustable gas regulator according to claim 1, wherein the gas block is a low profile gas block.

17. An adjustable gas regulator for use with a gas operated firearm, the adjustable gas regulator comprising:

a gas block configured to receive a barrel of a firearm and defining a gas block bore, the gas block bore defining a vent hole communicating the gas block bore with atmosphere;

a gas port defined within the gas block bore, the gas port being positioned to communicate with a gas port aperture of a firearm;

a gas regulating cylinder dimensioned to be rotatably received within a first end of the gas block bore, the gas regulating cylinder defining a plurality of cylinder gas ports spaced about the periphery of the cylinder, wherein the gas regulating cylinder is rotatably positioned within the gas block such that the gas regulating cylinder is selectively rotatable to position any one of the cylinder gas ports in communication with the gas port of the gas block bore; and a piston cylinder secured within a second end of the gas block bore, the piston cylinder and the gas regulating cylinder defining an anti-fouling cavity about the gas regulating cylinder within the gas block bore, wherein the vent hole communicates with the anti-fouling cavity.

* * * * *